US007040064B2

(12) United States Patent
Fritsche et al.

(10) Patent No.: US 7,040,064 B2
(45) Date of Patent: May 9, 2006

(54) MODULAR MULTI-CONFIGURABLE DISPLAY SYSTEM

(75) Inventors: Mark Fritsche, Eagan, MN (US); Dan Berg, Minneapolis, MN (US); Jason Johnson, Minneapolis, MN (US)

(73) Assignee: Skyline Displays, Inc., Eagan, MN (US)

( * ) Notice: Subject to any disclaimer, the term of this patent is extended or adjusted under 35 U.S.C. 154(b) by 0 days.

(21) Appl. No.: 10/939,532

(22) Filed: Sep. 13, 2004

(65) Prior Publication Data

US 2005/0039412 A1 Feb. 24, 2005

Related U.S. Application Data

(63) Continuation of application No. 10/662,132, filed on Sep. 12, 2003, now abandoned, which is a continuation-in-part of application No. 09/953,113, filed on Sep. 13, 2001, now abandoned.

(51) Int. Cl.
*E04H 1/00* (2006.01)

(52) U.S. Cl. ..... 52/239; 160/135

(58) Field of Classification Search ..... 160/135, 160/352, 328, 329, 405; 52/239, 730.1, 731.1, 52/696, 690; 40/605, 610; 211/189, 192, 211/103, 207

See application file for complete search history.

(56) References Cited

U.S. PATENT DOCUMENTS

| | | | | |
|---|---|---|---|---|
| 767,533 | A | 8/1904 | Warner | |
| 1,939,598 | A | 12/1933 | Ragsdale | |
| 2,900,870 | A * | 8/1959 | Jackson | 359/451 |
| 3,734,033 | A | 5/1973 | Downing | |
| 3,975,850 | A | 8/1976 | Giaume | |
| D242,099 | S | 11/1976 | Casey | |
| D242,100 | S | 11/1976 | Casey | |
| 4,064,995 | A | 12/1977 | Bustos | |
| 4,194,313 | A | 3/1980 | Downing | |
| 4,263,738 | A | 4/1981 | Donatelle | |
| D259,443 | S | 6/1981 | James | |
| 4,288,937 | A | 9/1981 | Virsen | |
| 4,471,548 | A | 9/1984 | Goudie | |
| 4,566,211 | A | 1/1986 | Gustafson et al. | |
| 4,593,826 | A | 6/1986 | Bustos | |
| 4,658,560 | A | 4/1987 | Beaulieu | |
| 4,759,159 | A | 7/1988 | Blazley | |
| 4,784,205 | A | 11/1988 | Johnson et al. | |
| 4,800,663 | A | 1/1989 | Zeigler | |

(Continued)

FOREIGN PATENT DOCUMENTS

| | | |
|---|---|---|
| CN | 3247677D | 7/2002 |

(Continued)

OTHER PUBLICATIONS

Skyline Displays, Inc., *ps2000 brochure*, 2001.

(Continued)

*Primary Examiner*—David Purol
(74) *Attorney, Agent, or Firm*—Patterson, Thuente, Skaar & Christensen, P.A.

(57) ABSTRACT

The modular multi-configurable display has a series of box frames and provides variable positioning for appurtenances. The display can include a plurality of vertical columns, and generally horizontal trusses. The columns are capable of receiving the trusses at each end of the columns. Each box frame can be stackable with another box frame such that the vertical span of the display is adjustable. Appurtenance can be attached at various positioning locations to the display such that a myriad of modular configuration combinations are available to an exhibitor.

26 Claims, 4 Drawing Sheets

U.S. PATENT DOCUMENTS

| | | | | | |
|---|---|---|---|---|---|
| 4,860,812 | A | * | 8/1989 | DePietro et al. | 160/135 |
| 4,862,615 | A | * | 9/1989 | Hillstrom | 40/603 |
| 4,901,499 | A | | 2/1990 | Mairlot | |
| 4,934,858 | A | | 6/1990 | Beaulieu | |
| D308,923 | S | | 7/1990 | Ewenson | |
| 4,941,717 | A | | 7/1990 | Beaulieu | |
| 4,986,038 | A | | 1/1991 | Backer | |
| 5,038,529 | A | | 8/1991 | Conley et al. | |
| 5,056,577 | A | | 10/1991 | DeLong et al. | |
| 5,092,385 | A | | 3/1992 | Beaulieu | |
| 5,111,631 | A | | 5/1992 | Flood et al. | |
| 5,115,623 | A | | 5/1992 | Ahlberg | |
| 5,119,613 | A | | 6/1992 | Atkinson et al. | |
| 5,123,550 | A | | 6/1992 | Nodskov et al. | |
| 5,193,603 | A | | 3/1993 | Whisnant | |
| 5,277,512 | A | | 1/1994 | Dwillies | |
| 5,323,836 | A | | 6/1994 | Tuttle et al. | |
| 5,351,843 | A | | 10/1994 | Wichman et al. | |
| 5,423,151 | A | * | 6/1995 | Caro et al. | 52/145 |
| 5,439,043 | A | * | 8/1995 | Carter | 160/135 |
| 5,486,391 | A | | 1/1996 | Tyner | |
| 5,495,952 | A | * | 3/1996 | Kainz | 211/90.04 |
| 5,501,051 | A | | 3/1996 | Harlan | |
| 5,537,766 | A | | 7/1996 | Nickens et al. | |
| 5,561,960 | A | | 10/1996 | Minnick et al. | |
| 5,584,156 | A | | 12/1996 | Lange | |
| 5,588,274 | A | | 12/1996 | Lange | |
| 5,611,384 | A | * | 3/1997 | Carter | 160/135 |
| D386,330 | S | | 11/1997 | Russell | |
| 5,706,622 | A | | 1/1998 | Lange | |
| 5,711,131 | A | | 1/1998 | Thomas | |
| D392,753 | S | | 3/1998 | Kohlberger et al. | |
| 5,822,945 | A | | 10/1998 | Muller | |
| 5,875,596 | A | | 3/1999 | Muller | |
| 6,079,178 | A | | 6/2000 | Fisher | |
| 6,149,021 | A | | 11/2000 | Beaulieu | |
| 6,158,187 | A | | 12/2000 | Nakajima | |
| 6,419,331 | B1 | | 7/2002 | Wei | |
| D471,726 | S | | 3/2003 | Berg et al. | |
| D472,719 | S | | 4/2003 | Berg et al. | |
| D473,385 | S | | 4/2003 | Joergensen | |
| 6,571,519 | B1 | * | 6/2003 | Diffrient et al. | 52/239 |
| 6,615,562 | B1 | | 9/2003 | Fritsche et al. | |
| D482,204 | S | | 11/2003 | Berg et al. | |
| D482,877 | S | | 12/2003 | Berg et al. | |
| 6,659,159 | B1 | * | 12/2003 | Fritsche et al. | 160/371 |
| D485,995 | S | | 2/2004 | Berg et al. | |
| 6,712,229 | B1 | | 3/2004 | Fritsche et al. | |
| 6,715,255 | B1 | | 4/2004 | Schipani et al. | |
| D497,498 | S | | 10/2004 | Berg et al. | |

FOREIGN PATENT DOCUMENTS

| | | |
|---|---|---|
| KR | 20-0234930 | 10/2001 |
| KR | 20-0234977 | 10/2001 |
| KR | 30-0298304-0000 | 5/2002 |
| KR | 30-0298305-0000 | 5/2002 |
| KR | 30-0298306-0000 | 5/2002 |
| KR | 10-0376542 | 10/2002 |
| KR | 10-0428425 | 10/2002 |
| KR | 20-0313104 | 5/2003 |
| KR | 30-0338741-0000 | 11/2003 |
| KR | 20-0353133 | 6/2004 |
| KR | 20-0353490 | 6/2004 |
| WO | WO 02/081837 | 10/2002 |

OTHER PUBLICATIONS

Skyline Displays, Inc., *imagine that. brochure*, 2000.
Skyline Displays, Inc., *design ideas brochure*,2000.
Skyline Displays, Inc., *How Do You Market our e-Business Offline? brochure*, 2001.
Skyline Displays, Inc., *mirage plus brochure*, 2001.
Skyline Displays, Inc. *skytruss brochure*, 2001.
Trussworks, Truss Catalog web page printout, *Truss Parts*, Aug. 17, 2001.
Trussworks, Truss Catalog web page printout, *Trussworks Photos, Graphics Frame*, p. 1, Aug. 17, 2001.
Trussworks, Truss Catalog web page printout, *Trussworks Photos, Graphics Frame*, p. 2, Aug. 17, 2001.
Trussworks, Truss Catalog web page printout, *Trussworks Photos, Exhibit Photos*, p. 1, Aug. 17, 2001.
Trussworks, Truss Catalog web page printout, *Trussworks Photos, Graphics Frame*, p. 12 Aug. 17, 2001.

* cited by examiner

MODULAR MULTI-CONFIGURABLE DISPLAY SYSTEM

RELATED APPLICATIONS

The present application is a continuation of U.S. patent application Ser. No. 10/662,132, filed Sep. 13, 2003, entitled, "MODULAR MULTI-CONFIGURABLE DISPLAY SYSTEM", which is now abandoned which in turn is a continuation-in-part application of U.S. patent application Ser. No. 09/953,113, filed Sep. 13, 2001, entitled, "MODULAR MULTI-CONFIGURABLE DISPLAY SYSTEM", which is now abandoned, hereby fully incorporated by reference herein in their entirety.

FIELD OF THE INVENTION

The present invention relates to displays, and in particular, to a modular display system for the multi-configurable assembly of a display stand at a trade show or other exhibition.

BACKGROUND OF THE INVENTION

Trade shows have been common for some time as a means for companies to significantly expand their client base. Generally, a trade show exhibitor is allocated a specific limited space within a large hall in which to set up a booth or display. It has been common practice for these exhibitors to purchase specially designed displays to showcase their products or services.

These conventional displays usually include a "back wall." This back wall is set as the focal point for the exhibition. However, while these back walls have generally been readily available and portable, they are often very limited in their use and can be quite expensive. For the most part, the currently available back walls come in limited configurations, with the display manufacturer designing a back wall specifically for the exhibitor. Consequently, conventional back walls are truly customized and are only capable of a limited number of configurations. Rectangular paneled back walls are often the only real configuration option and the exhibitor is only able to modify the look of the wall through the addition of furniture and shelves at predetermined locations.

The lack of configuration flexibility is problematic. First, trade show facilities can vary greatly. The overall size and shape of the exhibit space is an important consideration. A small space may require a reduction in the size of the back wall, while a larger space may present opportunities for the exhibitor to expand the wall and the draw or appeal of the exhibited products or services. In addition, a uniquely shaped booth space may present a problem for those exhibitors utilizing conventional back wall displays since the wall cannot be configured to conform with the space.

Second, exhibitors may wish to periodically change the configuration of the back wall for non-functional reasons. An exhibitor may simply wish to have options available to vary the look of the back wall in order to highlight specific products, influence a particular trade show audience, or for many other creative and aesthetic reasons. However, conventional back wall display systems are generally limited in this respect.

Limited component shapes, such as those used in rectangular panel systems, restrict the ability of an exhibitor to creatively configure the wall. Consequently, there is a need for a display booth back wall system that includes various components of convenient interchangeable shapes and sizes that permit an exhibitor to assemble the wall in a myriad of modular configurations. In addition, the back wall system must be designed for ease of disassembly and portability to accommodate the demands of trade show exhibitors.

SUMMARY OF THE INVENTION

The modular multi-configurable display system of the present invention includes multiple interchangeable components. Namely, the system includes a plurality of vertical columns, a plurality of horizontal truss members, including arcuate members, and a plurality of linear member. The columns are capable of fixedly removably receiving the horizontal arcuate and linear members at each end of the columns. Each column may be formed of one or typically two elongated box frames that are removably stackable and connectable with respect to each other. Each box frame has elongate frame members secured and braced with webbing only at the ends. Whereby appurtenant components can be attached at various positioning locations to a columns. Similarly, in a preferred embodiment, the trusses have only end webbing, no intermediate webbing, thereby providing substantially the entire length of the truss for attachment positions for appurtenances. A myriad of modular configuration combinations are available to an exhibitor.

A significant advantage and feature of the modular multi-configurable display system of the present invention is that configuration options are increased to accommodate an exhibitor's specific needs or creative desires.

Another significant advantage and feature of the present invention is its modular interchangeability and connectability. Each modular component (i.e., the arcuate and linear members) is in connectable communication with other components of identical or different design through an intermediary connection with a frame assembly. Common connectability with a frame assembly permits flexibility in defining the overall shape and size of the display wall. In addition, a specific component is not directed or limited to a particular connection position, or to an individually designated frame assembly. This significantly increases the ease of assembly and decreases the time associated with assembly and disassembly.

DETAILED DESCRIPTION OF THE PREFERRED EMBODIMENTS

Figure 1:
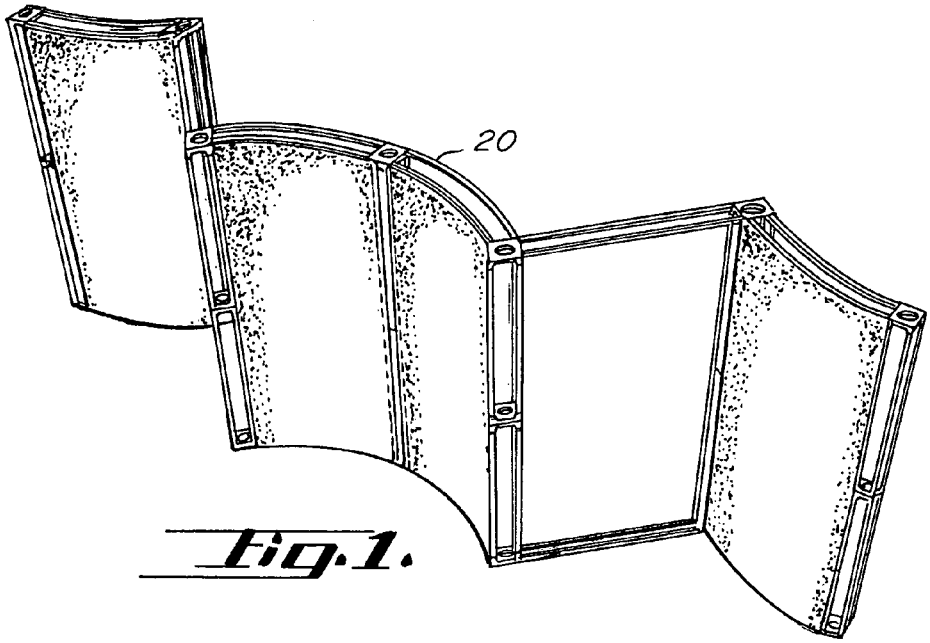
FIG. 1 is a perspective view of a display in accordance with the invention herein.
Figure 2:
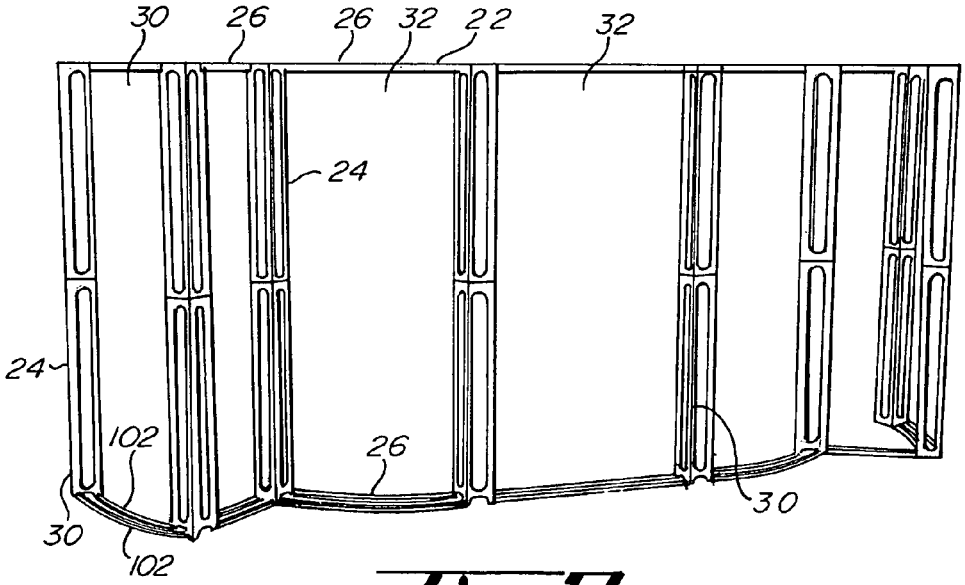
FIG. 2 is a front perspective view of a framework for a display.
Figure 9A:
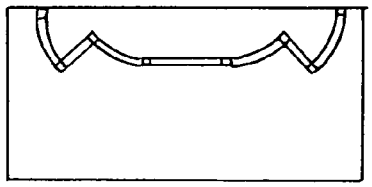
FIG. 9*a* is a plan view of one configuration of the modular multi-configurable display wall system of the present invention.
Figure 9B:
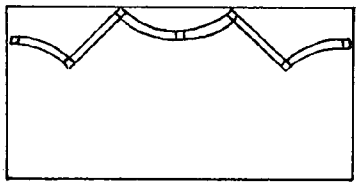
FIG. 9*b* is a plan view of another configuration of the modular multi-configurable display wall system of the present invention.
Figure 9C:
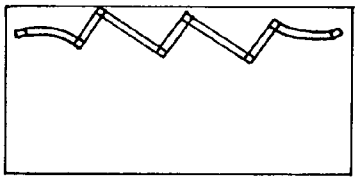
FIG. 9*c* is a plan view of yet another configuration of the modular multi-configurable display wall system of the present invention.

Referring to FIGS. 1 and 2, a display 20 suitable back wall of trade show exhibits is illustrated. FIG. 2 illustrates the framework 22 for the display and is generally comprised of a plurality of vertical columns 24 and a plurality of trusses 26 that are combined to form a series of graphical screen window frames 30 defining a plurality of graphical screen windows or openings 32. The window frames are generally laid out in a sequential manner to form a structurally stable display due to the serpentine shape.

Figure 3:
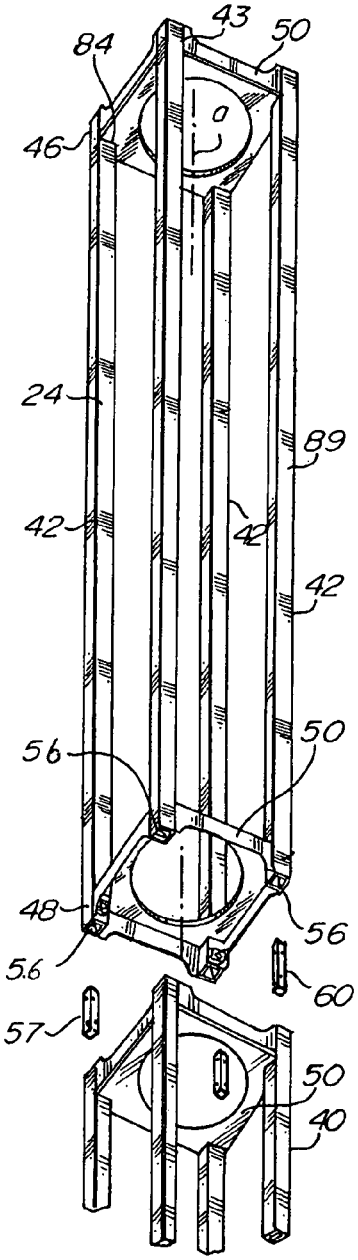
FIG. 3 is an exploded view of a column in accordance with the invention herein.
Figure 4:
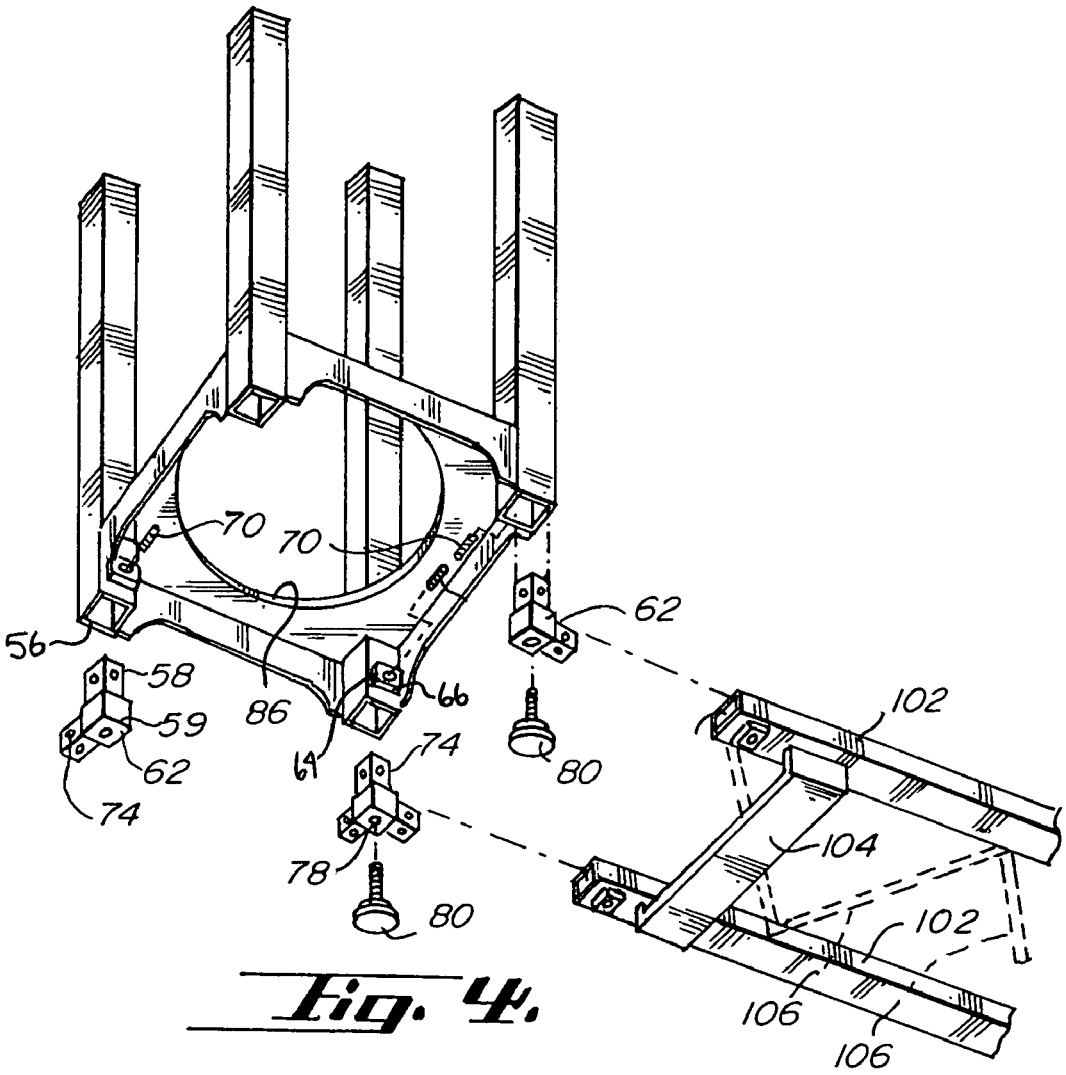
FIG. 4 is an exploded view of the connection between an elongate box frame and a truss.

Referring to FIG. 3, a portion of a vertical column 24 is illustrated. The column is composed of two elongated box frames 40, each presenting a longitudinal axis a. Each box frame in a preferred embodiment is comprised of four frame tubing segments 42 formed from square steel tubing. Each framed segment 42 has a first end 46 and a second end 48. Each of the respective first ends 46 of the four framed segments 42 is joined together by an end webbing 50 as well as are the second ends 48. The ends 46, 48 of the frame tubing segments 42 are opened defining a socket 56, which facilitates connection to another elongated box frame 40 or to a truss 26. Said connections are facilitated by in line connectors 60 as illustrated in FIG. 3, or right angle connectors 62 as illustrated in FIG. 4. In line connectors 60 have a portion 57, which is sized so as to be received in socket 56 of the frame tubing segments 42. The ends of the elongate box frames 46, 48 also have threaded portions 64 configured as nuts 66 welded onto the ends 48 of the steel tubing frame segments 42. Set screws 70 are threaded through threaded portions 64 to frictionally contact and thereby attach the connectors 60, 62. The connectors will preferably have indentations 74 at the set screw location points. Similarly, the right angle connectors 62 have a portion 58 sized so as to be received in socket 56. Right angle connectors 62 may also have body portion 59, which is sized slightly larger than socket 56 as depicted in FIG. 4. The right angle connectors may also have threaded bores 78 for attachment of feet 80 or other appurtenances.

Figure 5:
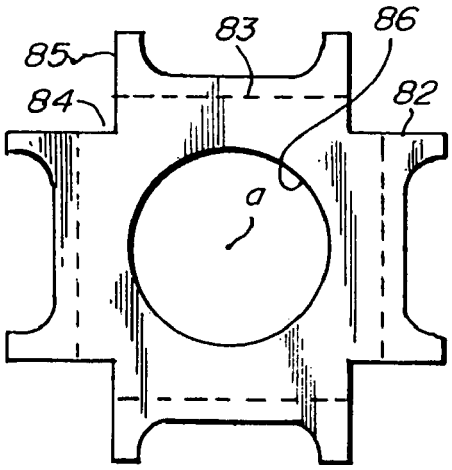
FIG. 5 is a plan view of a stamping for forming an end webbing.
Figure 5B:
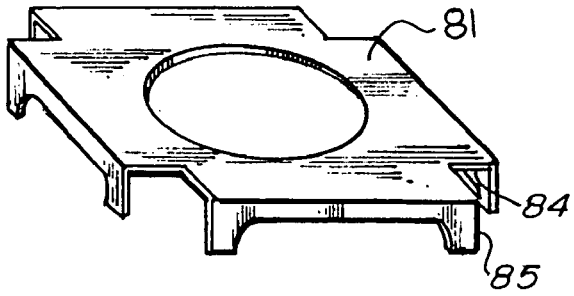
FIG. 5*b* is a perspective view of a formed webbing.

A piece of sheet steel 81 is illustrated in FIG. 5 and 5*b*, which is suitable for forming the end webbing 50. Sheet steel piece 81 has notches 84 which conform in shape and dimension to the exterior of tubular frame segments 42. Perpendicular portions 85 as depicted in FIG. 5*b* are formed by bending sheet steel piece 81 along folding lined 83. To lighten the assembly, end webbing 50 may have one or more apertures 86 formed therein. The end webbing 50 is welded onto each of the four tubular frame segments 42 at welds 43 to form an optimally strong and light structure. Although the end webbing as illustrated is formed of a single unitary piece, it is also contemplated that the webbing could be formed of individual strips bridging individual frame segments. Thus webbing is defined as the structure securing segments together, whether a single unitary piece or multiple pieces.

Figure 8:
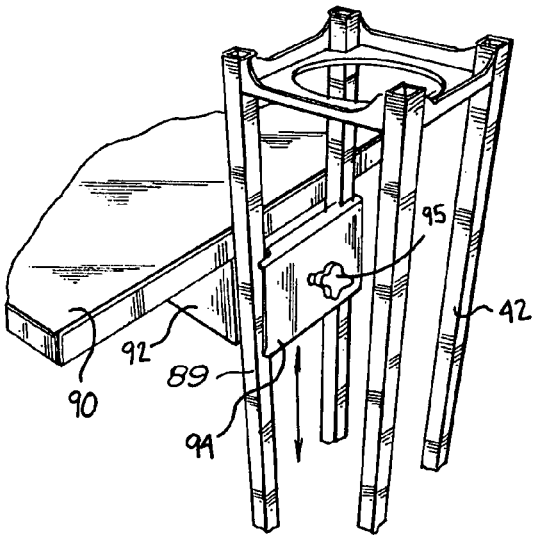
FIG. 8 is a perspective view of a table adjustably mounted on an elongate box frame.
Figure 7:
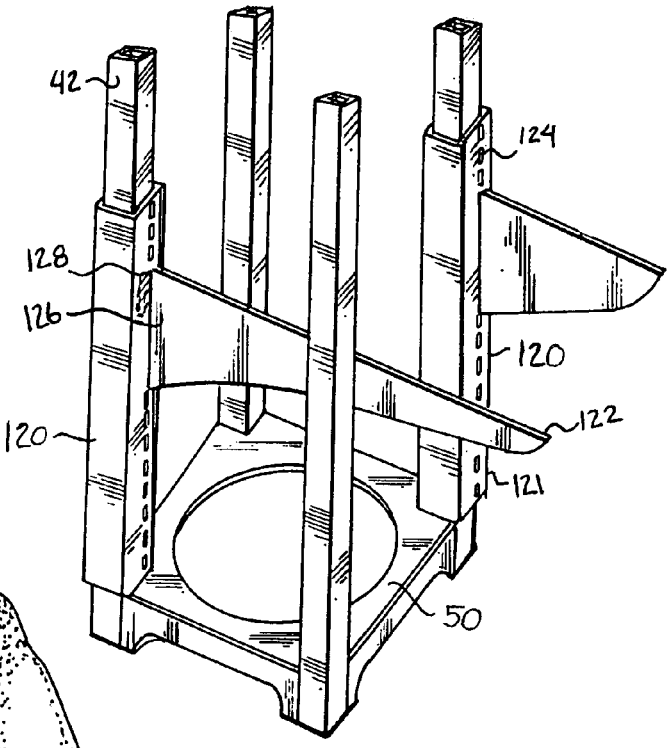
FIG. 7 is a perspective view of an elongate box frame and appurtenance attachment means.

Significantly, the elongated box frames 40 have an intermediate portion 89 positioned intermediate the end webbing 50; said intermediate portion 89 does not have any webbing or bracing. This facilitates four "clean" frame segments for variable positioning of appurtenances as illustrated in FIGS. 7 and 8, for providing an aesthetically pleasing and uncluttered look. In an ideal embodiment the clean intermediate portion 89 without webbing will constitute 70 percent or more of the length of the box frame 40.

As depicted in FIGS. 7 and 8, various appurtenances may be positioned along intermediate portion 89 of box frame 40. In FIG. 7, for example, a shelving support apparatus 120 is depicted. The apparatus generally includes a frame attachment portion 121 and a shelf support member 122. Shelf support member 122 may be a typical shelf support commonly used with adjustable shelving systems. As depicted in FIG. 7, the member 122 typically has a proximal end 126 with a plurality of downwardly directed hooks 128. Frame attachment portion 121 is u-shaped so as to fit over and secure to frame segments 42. A plurality of vertically aligned slots 124, each sized to receive a hook 128, are provided in frame attachment portion 121. Each shelf support member 122 may be attached to a frame attachment portion 121 by inserting hooks 128 into corresponding slots 124, and moving the shelf support downwardly, thereby hooking the hooks 128 into the slots 124. Another exemplary embodiment of a shelf support is depicted in FIG. 8. In this embodiment, shelf 90 has projecting portion 92 confronting frame segments 42. Threaded knob 95 extends through clamping portion 94, and threads into projecting portion 92. If threaded knob 95 is tightened, frame segments 42 are trapped and frictionally secured between projecting portion 92 and clamping portion 94, thereby providing a support for shelf 90. Shelf 90 may be positioned in any desired position along frame segments 42 by loosening threaded knob 95, sliding the shelf 90 along the frame segments 42 as depicted by the arrow until the desired position is reached, and retightening threaded knob 95.

Figure 6:
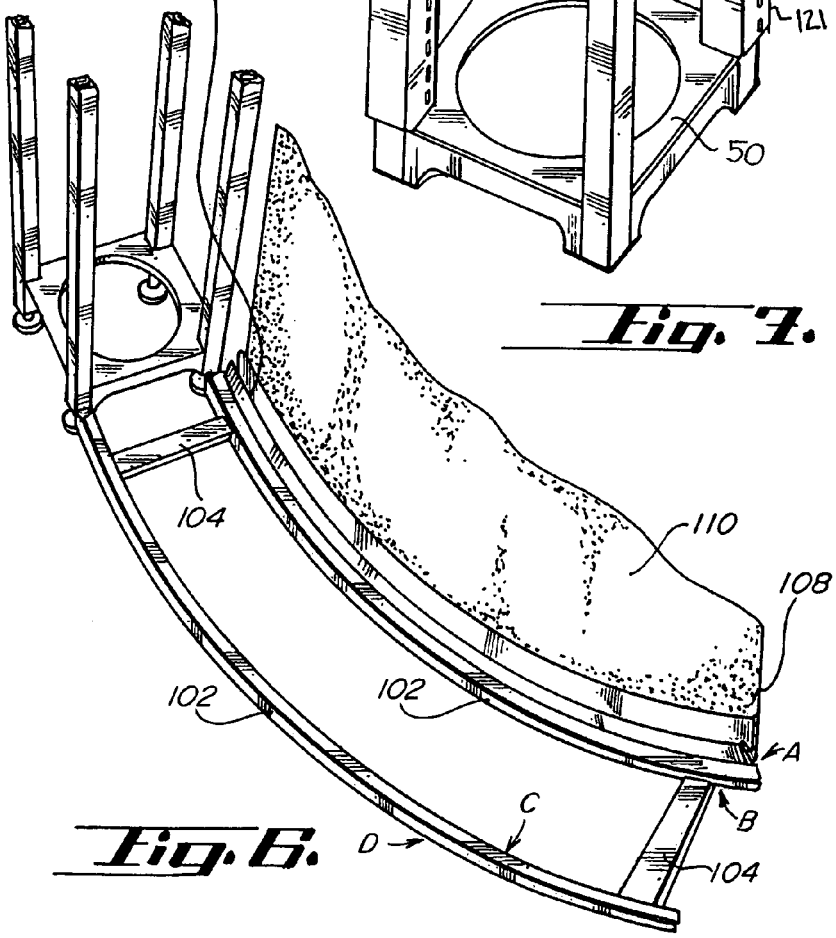
FIG. 6 is a perspective view of an elongate box frame, a truss and a graphic screen.

Referring to FIGS. 2, 4 and 6, details of the horizontal trusses 26 are illustrated. These trusses 26 may be linear in configuration as illustrated in FIG. 4 and 1 or may be arcuate as illustrated in FIG. 6 and 1. In either case, the trusses have parallel frame segments 102, which may be joined by webbing members 104 proximate the ends, or alternatively by conventional webbing 106 as depicted in FIG. 4.

As illustrated in FIG. 6, the horizontal trusses 26 are utilized for connection of the graphic screen panels 108 which due to the positioning of the unshaped webbing 104 on the bottom of the bottom truss and the top of the top truss, allows positioning of the screens 108 in four positions as identified by the arrows labeled as A, B, C and D in FIG. 6. This provides an extraordinary amount of flexibility in mounting the graphical screen. The horizontal trusses, in an alternate embodiment of the display may utilize conventional webbing 106 as illustrated by the dashed lines of FIG. 4.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

The invention claimed is:

1. A modular multi-configurable display wall system comprising:

a plurality of spaced columns, each spaced column comprising at least two stackable box frames operably alignably coupled together, each of the box frames including;

a plurality of frame tubing segments having first and second end portions;

a plurality of generally horizontal support webbings spaced apart and secured between each of the frame tubing segments, wherein a portion of each frame tubing segment between the spaced apart support webbings is free from bracing thereby presenting a generally unobstructed length adapted for attaching at least one appurtenance thereto, the plurality of support webbings each having a plurality of vertically extending side portions, each of the plurality of side portions being operably connected to at least two adjacent frame tubing segments in a plane generally parallel to the two adjacent frame tubing segments for bridging support; and at least one generally horizontal truss operatively connecting at least two of the plurality of spaced columns to define an open region, the at least one generally horizontal truss comprising at least one elongate frame tubing segment.

2. The modular multi-configurable display wall system of claim 1, wherein the at least one generally horizontal truss is generally arcuate.

3. The modular multi-configurable display wall system of claim 1, wherein the at least one generally horizontal truss is generally linear.

4. The modular multi-configurable display wall system of claim 1, wherein each of the frame tubing segments are formed from generally rectangular tubing.

5. The modular multi-configurable display wall system of claim 1, wherein the plurality of generally horizontal support webbings include a plurality of inset corners for attachment to at least two of the frame tubing segments.

6. The modular multi-configurable display wall system of claim 1, wherein the plurality of generally horizontal support webbings include a centrally disposed aperture extending therethrough.

7. A modular multi-configurable display wall, the modular display wall comprising:

at least two box frames operably stackably secured to one another to define a display column, each of the box frames having a plurality of spaced elongate frame tubing segments having opposed end portions;

a plurality of vertically spaced horizontal support webbing disposed along the box frames, each of the horizontal support webbings having at least a plurality of side plate portions extending along a plane generally parallel to a length of the elongate frame tubing segments for bridging support between the plurality of frame tubing segments; and at least one generally horizontal truss operably connected an opposed display frame structure to define an open region.

8. The modular multi-configurable display wall of claim 7, wherein the opposed display frame structure includes a columnar box frame structure generally the same height as the display column.

9. The modular multi-configurable display wall of claim 7, wherein the at least one generally horizontal truss comprises a plurality of generally parallel elongate frame tubing segments with webbing extending therebetween.

10. The modular, multi-configurable display wall of claim 7, further comprising at least one shelving support assembly, the at least one shelving support assembly including:

a shelf support member for supporting a shelf thereon and a plurality of attaching hooks; and a frame attachment portion removably securable to one of the frame tubing segments of the box frames, the attachment portion having a plurality of slots adapted to receive the attaching hooks.

11. The modular multi-configurable display wall of claim 7, wherein the at least one generally horizontal truss is generally arcuate.

12. The modular multi-configurable display wall of claim 7, wherein the at least one generally horizontal truss is generally linear.

13. A modular multi-configurable display wall system comprising:

a plurality of columns spaced apart from one another, each column having at least two operably stacked elongated box frames, each of the stacked elongated box frames including a plurality of spaced apart generally parallel elongate frame tubing segments having a pair of opposing end portions;

at least two vertically spaced support webbings disposed along a length of the frame tubing segments of each box frame between the opposing end portions, each of the support webbings having means for providing bridging support between the respective frame tubing segments, with the length of the frame tubing segments between the at least two support webbings being substantially without cross bracing; and means for operably connecting at least two of the plurality of spaced apart columns to define at least one open region.

14. The modular multi-configurable display wall system of claim 13, wherein the means for connecting at least two of the plurality of columns includes at least one generally horizontal truss.

15. The modular multi-configurable display wall system of claim 14, wherein the at least one generally horizontal truss is generally arcuate.

16. The modular multi-configurable display wall system of claim 14, wherein the at least one generally horizontal truss is generally linear.

17. The modular multi-configurable display wall system of claim 13, further comprising at least one shelf support member and means for attaching the at least one shelf support member to at least one of the plurality of generally parallel elongate frame tubing segments.

18. The modular multi-configurable display wall system of claim 13, wherein a plurality of the columns are movably arrangeable into a generally serpentine pattern.

19. A method of constructing a modular multi-configurable display wall system, comprising the steps of:

providing a plurality of box frames, wherein at least one of the box frames includes a plurality of spaced apart generally parallel elongate frame tubing segments, each frame tubing segment having a pair of opposing end portions, the frame tubing segments being connected by vertically spaced apart support webbings disposed between the opposing end portions, wherein a portion of each frame tubing segment between opposing end portions is generally free from angled cross bracing for attaching at least one appurtenance to each of the frame tubing segments, and wherein each of the support webbings includes side plate portions spanning generally transversely to and between respective parallel frame tubing segments to provide bridging support;

operably stacking two of the plurality of box frames to define a first box frame column;

operably stacking another two of the plurality of box frames to define a second box frame column;

positioning the first and second box frame columns a distance apart; and operably connecting the first and second box frame columns with at least one generally horizontal truss to define an open region.

20. The method of claim 19, wherein the support webbings further include a top plate portion and wherein the support webbings are formed by bending a portion of the top plate portion to form the side plate portions.

21. The method of claim 19, wherein the step of operably connecting at least one generally horizontal truss further includes providing at least one generally horizontal truss that is generally arcuate.

22. The method of claim 19, wherein the step of operably connecting at least one generally horizontal truss further includes providing at least one generally horizontal truss that is generally linear.

23. A modular multi-configurable display wall system comprising:

a plurality of columns spaced apart from one another and interconnected by horizontal trusses, the columns and horizontal trusses defining a plurality of graphical screen window frames or openings, the graphical screen window frames each having a screen disposed therein, each column comprising at least two stacked elongated box frames, each of the stacked elongated box frames comprising four parallelpiped elongate square tubing segments supported by webbing extending between the four parallelpiped tubing segments; and each column of said plurality of columns having a plurality of clean intermediate portions of equal length extending along the square tubing segments wherein said clean intermediate portions consist of the tubing segments and without bracing and without webbing therebetween.

24. The modular multi-configurable display wall system of claim 23 wherein the portion of elongate box frame without webbing and without bracing is at least 70%.

25. A modular multi-configurable display wall system comprising:

a plurality of columns spaced apart from one another and interconnected by horizontal trusses, the columns and horizontal trusses defining a plurality of graphical screen window frames or openings, the graphical screen window frames each having a screen disposed therein, said plurality of columns comprised four parallelpiped elongate square tubing segments supported by webbing extending between the four parallelpiped tubing segments and extending along a portion of the length of the columns; and each column of said plurality of columns having a plurality of clean intermediate portions extending along the length of the column, each clean intermediate portion consisting of laterally adjacent portions of four parallelpiped elongate square tubing segments with a continuous void therebetween and no bracing or webbing positioned at said adjacent portions of the four parallelpiped elongate square tubing segments, each column comprised mostly of the clean intermediate portions compared to lengthwise portions of the column having either or both of webbing and bracing.

26. The modular multi-configurable display wall system of claim 25 wherein each column comprises a box frame and wherein the lengthwise portion of the elongate box frame without webbing and without bracing is at least 70%.

* * * * *